US012060187B2

(12) United States Patent
Lindblad et al.

(10) Patent No.: US 12,060,187 B2
(45) Date of Patent: Aug. 13, 2024

(54) FILLING MACHINE WITH HYGIENIC CHAMBER

(71) Applicant: TETRA LAVAL HOLDINGS & FINANCE S.A., Pully (CH)

(72) Inventors: Ulf Lindblad, Bjärred (SE); Mårten Regner, Lund (SE); Jenny Lindblad, Bjärred (SE); Bo Runnberg, Smedstorp (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 177 days.

(21) Appl. No.: 17/762,171

(22) PCT Filed: Sep. 30, 2020

(86) PCT No.: PCT/EP2020/077312
§ 371 (c)(1),
(2) Date: Mar. 21, 2022

(87) PCT Pub. No.: WO2021/063992
PCT Pub. Date: Apr. 8, 2021

(65) Prior Publication Data

US 2022/0371761 A1 Nov. 24, 2022

(30) Foreign Application Priority Data

Oct. 4, 2019 (EP) ..... 19201541

(51) Int. Cl.
*B65B 55/04* (2006.01)
*B65B 9/06* (2012.01)
(Continued)

(52) U.S. Cl.
CPC ..... *B65B 55/027* (2013.01); *B65B 9/06* (2013.01)

(58) Field of Classification Search
CPC ..... B65B 55/00; B65B 55/02; B65B 55/025; B65B 55/027; B65B 55/04
See application file for complete search history.

(56) References Cited

U.S. PATENT DOCUMENTS 5,064,614 A 11/1991 Reiss et al.
5,534,222 A 7/1996 Kelbrick et al.
(Continued)

FOREIGN PATENT DOCUMENTS

CN 1481333 A 3/2004
CN 102341308 A 2/2012
(Continued)

OTHER PUBLICATIONS

International Search Report (PCT/ISA/210) and Written Opinion (PCT/ISA/237) mailed on Dec. 8, 2020, by the European Patent Office as the International Searching Authority for International Application No. PCT/EP2020/077312. (12 pages).

*Primary Examiner* — Praachi M Pathak
(74) *Attorney, Agent, or Firm* — BUCHANAN INGERSOLL & ROONEY PC

(57) ABSTRACT

A filling machine configured to form, fill, and seal individual packages is provided. The filling machine comprises a disinfection station and a hygienic chamber downstream the disinfection station, which hygienic chamber is configured to reduce the risk for re-contamination of the packages after passing the disinfection station. An inner hygienic zone is formed inside the hygienic chamber, whereby a positive air flow is established from the inner hygienic zone to the hygienic chamber outside the inner hygienic zone.

12 Claims, 6 Drawing Sheets

(51) Int. Cl.
*B65B 55/00* (2006.01)
*B65B 55/02* (2006.01)

(56) References Cited

U.S. PATENT DOCUMENTS

| | | | | |
|---|---|---|---|---|
| 5,865,010 | A | 2/1999 | Sundby et al. | |
| 6,820,660 | B1 | 11/2004 | Ludwig | |
| 2005/0252176 | A1 * | 11/2005 | Pritchard | B65B 9/08 53/469 |
| 2018/0186480 | A1 | 7/2018 | Mainz et al. | |

FOREIGN PATENT DOCUMENTS

| | | | |
|---|---|---|---|
| CN | 107567416 | A | 1/2018 |
| DE | 39 31 672 | A1 | 4/1991 |
| DE | 102015101751 | A1 | 8/2016 |
| EP | 0903297 | A1 * | 8/1998 |
| EP | 1645813 | A2 | 4/2006 |
| JP | H0516926 | A | 1/1993 |
| JP | H10205153 | A | 8/1998 |
| JP | H1191720 | A | 4/1999 |
| JP | H11-236014 | A | 8/1999 |
| JP | 2003513861 | A | 4/2003 |
| WO | 0134477 | A1 | 5/2001 |
| WO | 2010/104445 | A1 | 9/2010 |
| WO | 2017038484 | A1 | 3/2017 |

* cited by examiner

FILLING MACHINE WITH HYGIENIC CHAMBER

TECHNICAL FIELD

The invention relates to a filling machine, in particular to a filling machine being configured to form, fill, and seal individual packages. The present invention also relates to a method for such filling machine.

BACKGROUND ART

Within the food industry, beverages and other products are often packed in paper or paperboard based packages. Packages intended for liquid food are often produced from a packaging laminate comprising a core layer of paper or paperboard and an outer, liquid-tight layer of thermoplastic material on at least that side of the core layer which will form the inside of the packages.

One kind of frequently occurring packages are produced from so-called ready-to-fill packages. Such ready-to-fill package is provided as a sleeve of packaging laminate like the one described above, being sealed at its bottom end prior to filling. The upper end may either be formed by sealing and forming the upper end of the sleeve, or by adding an upper part in the form of e.g. a plastic top; the upper end/part may be provided with an opening/closing means, such as a screw cap.

The open-ended packaging material sleeve is received at an infeed station of the filling machine, whereafter the bottom end is sealed; the semi-finished package has at this point a shape being ready to fill, however further processes are required to provide a hygienic packaging. At a downstream station, the open sleeves are sterilized or disinfected at least on the inside in order to extend the shelf-life of the product to be stored in the packages. Depending on the desired length of shelf-life, and depending on whether the packages are to be distributed and stored in a refrigerated environment or at room temperature, different levels of sterilization/disinfection may be obtained.

After sterilization/disinfection of the packages, they are further transported to a filling zone for product filling, a sealing zone for sealing of the open end, and typically also to a final forming zone for final forming of the package.

Transportation of the packages is achieved by a sequence of carriers being guided along a conveying path. The conveying path is preferably continuous through the filling machine, such that a stream of packages is moving through the filling machine and all required stations.

After disinfection/sterilization of the ready-to-fill packages it is important to maintain hygienic conditions as the packages are filled and sealed by the associated stations. Hence, these filling machine stations are installed in a hygienic zone in order to ensure minimum re-contamination of the already sterilized or disinfected packages.

In order to allow for proper filling, sealing, and transport of the packages within the hygienic zone, complex mechanics and geometries are required. The constructional parts used in the filling and sealing stations in the hygienic zone (as well as associated stations for forming, etc.) are subject to service and maintenance; these stations must be accessed every now and then for high performance operation of the filling machine.

However, each time the hygienic zone is accessed there is a risk that unwanted particles and micro-organisms enter from outside, thereby increasing the risk of re-contamination of the packages.

As the speed and complexity of the filling machines are increasing in order to accommodate customer's needs, there is also increased need for service and maintenance, thereby requiring machine downtime and access to the hygienic zone.

Hence, there is a need for a filling machine reducing the risk for re-contamination of packages because of service and maintenance of components arranged within the hygienic zone.

SUMMARY

It is an object of the invention to at least partly overcome one or more of the above-identified limitations of the prior art. In particular, it is an object to provide a hygienic zone of a filling machine which reduces the risk for re-contamination of packages being present within the hygienic zone.

To solve these objects a filling machine is provided. The filling machine is configured to form, fill, and seal individual packages whereby the filling machine comprises a disinfection station and a hygienic chamber downstream the disinfection station, which hygienic chamber is configured to reduce the risk for re-contamination of the packages after passing the disinfection station. An inner hygienic zone is provided inside said hygienic chamber, whereby a positive air flow is established from the inner hygienic zone to the hygienic chamber outside the inner hygienic zone.

The inner hygienic zone may be formed by a plurality of separation plates of which at least one is moveable such that the inner hygienic zone can be opened and accessed.

The separation plates may extend from a ceiling towards the floor, leaving a slit between the bottom end of the respective separation plates and the floor.

The separation plates may be distributed in an U-shape such that at least two longitudinal separation plates extend in the machine direction, and at least one transversal separation plate may extend perpendicular to the machine direction, connecting the two longitudinal separation plates.

At least one of the separation plates may be moveable in order to increase or reduce the size of the inner hygienic zone.

The inner hygienic zone may be open towards the upstream disinfection station.

The inner hygienic zone may be provided with a filtered air unit. The filtered air unit may be arranged at the ceiling of the inner hygienic zone. The filtered air unit is a high efficiency particulate absorbing (HEPA) filter unit.

The positive air flow from the inner hygienic zone may be controlled by controlling the air flow of the filtered air unit.

The hygienic chamber may comprise an air evacuation unit arranged outside the inner hygienic zone. The air evacuation unit may be arranged at the ceiling of the hygienic chamber.

According to a second aspect, a method for a filling machine configured to form, fill, and seal individual packages is provided. The filling machine comprises a disinfection station and a hygienic chamber downstream the disinfection station, which hygienic chamber is configured to reduce the risk for re-contamination of the packages after passing the disinfection station. The method comprises the steps of providing an inner hygienic zone inside said hygienic chamber, and establishing a positive air flow from the inner hygienic zone to the hygienic chamber outside the inner hygienic zone.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
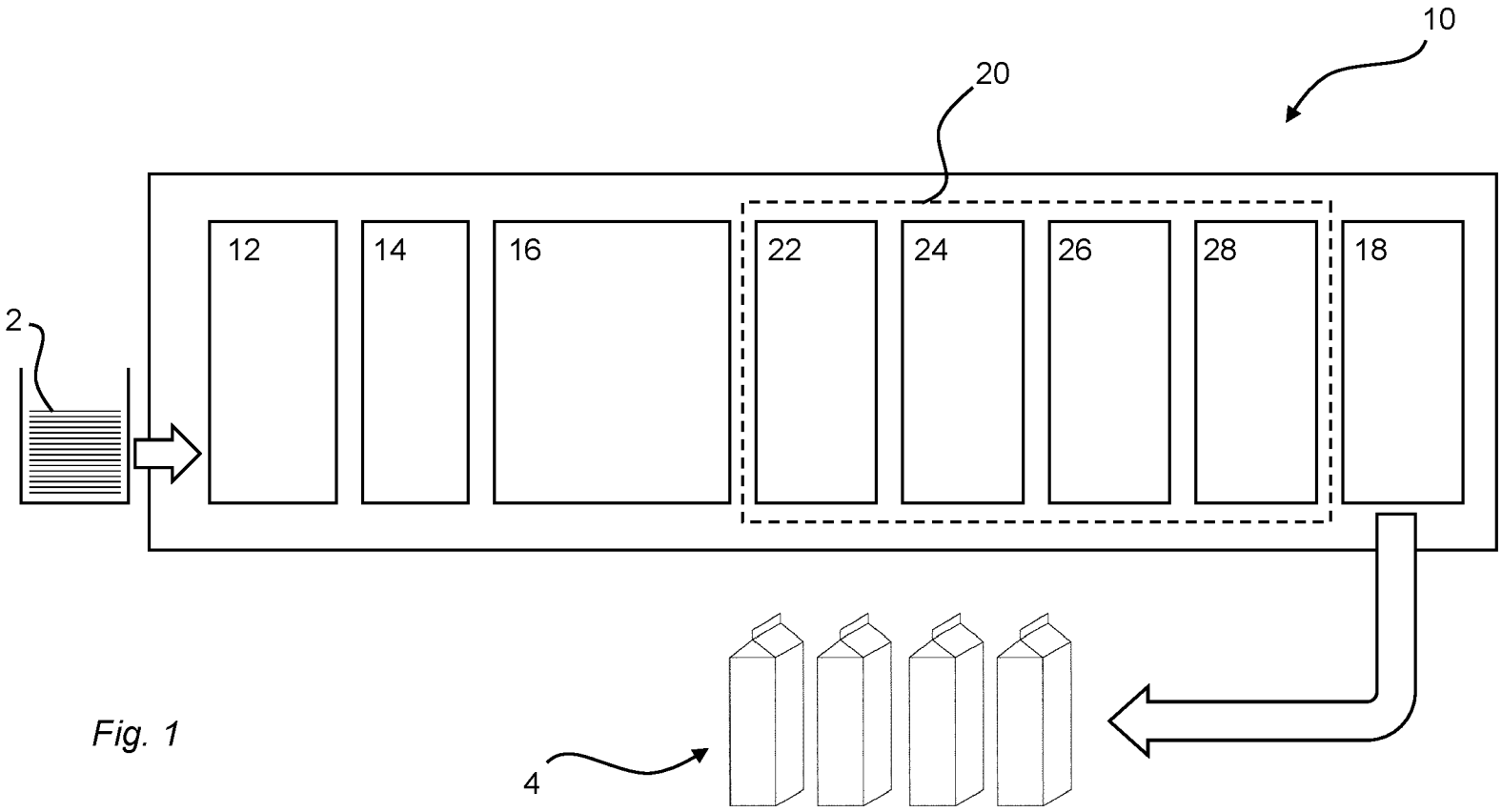
FIG. 1 is a schematic view of a filling machine according to an embodiment.

With reference to FIG. 1 a filling machine 10 is shown schematically. The filling machine 10, being configured to form, fill, and seal packages 4, has an infeed station 12 in which blanks 2 of packaging material are received. The blanks 2 are typically produced as sleeves of a carton-based packaging material, as is well known in the art and already described briefly in the background section. The infeed station 12 is arranged upstream a bottom sealing station 14, in which the blanks 2 are erected to a sleeve-shape, and in which station the bottom end of each blank is sealed to form a semi-finished package having one bottom end being closed, while the upper end is still open.

The semi-finished packages are transported to a disinfection station 16, in which the amount of living microorganisms is reduced. As explained in the background section, the level of disinfection may vary depending on user objectives. Disinfection of the packaging material may e.g. be accomplished by means of treatment with hydrogen peroxide, UV light, electron beam radiation, etc. At the end of the filling machine, an outfeed station 18 is arranged which is configured to discharge the finished packages 4 from the filling machine 10 to downstream equipment, storage, and/or transport.

A hygienic chamber 20 is provided between the disinfection station 16 and the outfeed station 18. The hygienic chamber 20 comprises further stations of the filling machine; immediately downstream the disinfection station 16 a filling station 22 is arranged. Here, the ready-to-fill packages are filled with their desired content. After filling, the packages may be transported to a pre-folding station 24 in which the upper part of the open-ended package is formed to a desired shape. After pre-forming the packages are transported to a heating station 26 in which heat-sealable material of the packaging material is heated to an elevated temperature. The elevated temperature of the upper end of the packages facilitates sealing of the upper end when the packages enter the sealing station 28 arranged immediately after the heating station 26.

Once sealed, the packages 4 do no longer require hygienic conditions whereby they exit the hygienic chamber 20, and are discharged (as previously explained) by means of the outfeed station 18.

It should be realized that the hygienic chamber 20 may comprise more or less filling machine stations, as long as it provides hygienic conditions to the ready-to-fill packages at least for some time after disinfection or sterilization of the ready-to-fill packages. It should also be mentioned that the filling machine 10 may not be constructed exactly as described with reference to FIG. 1, but the filling machine 10 may also be configured to produce other type of packages, such as plastic top packages, etc.

Figure 2:
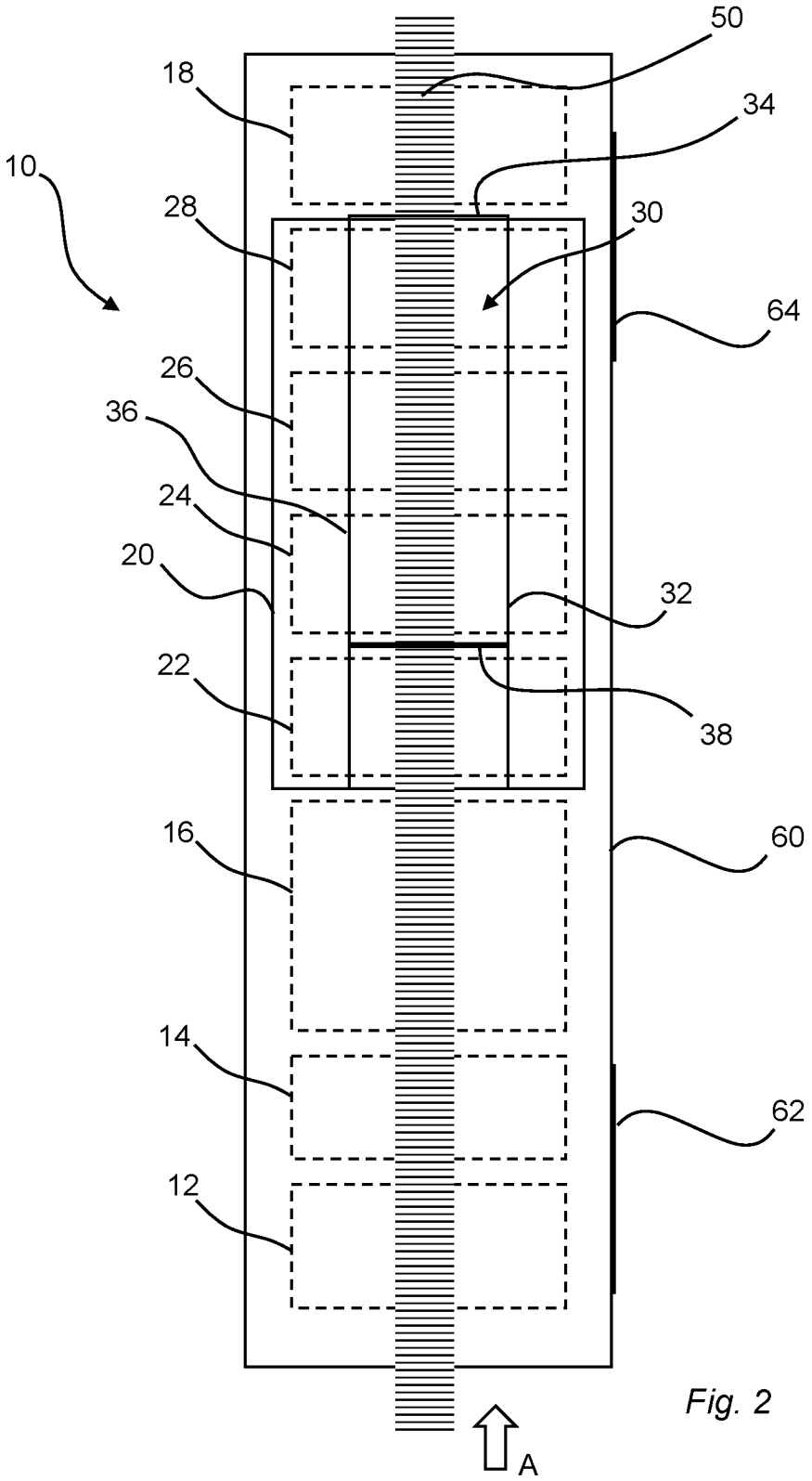
FIG. 2 is a top view of a filling machine according to an embodiment.

In FIG. 2 an embodiment of a filling machine 10 is shown in further details, especially with regards to the hygienic chamber 20. The filling machine stations, i.e. the infeed station 12, the bottom end sealing station 14, the hygienic station 16, etc. are all indicated by dashed lines and given the same reference numerals as of FIG. 1. Also in FIG. 2 a transport path 50 is indicated, representing the conveyors and carriers used to transport the packages, in the direction indicated by arrow A, from the infeed station 12 to the outfeed station 18.

The hygienic chamber 20 covers the entire space of the filling machine 10 from the disinfection station 16 to a downstream position where the packages are entirely sealed; for the shown filling machine 10, this occurs after the top end sealing station 28.

Inside the hygienic chamber 20 an inner hygienic zone 30 is defined. The inner hygienic zone 30 forms a space inside the hygienic chamber 20, extending essentially across the entire length of the hygienic chamber 20 but only across parts of the width of the hygienic chamber 20. As is shown in FIG. 2, the inner hygienic zone 30 is formed by at least three walls 32, 34, 36. A first wall 32 extends on one side of the transport path 50 from the outfeed end of the disinfection station 16, in a machine direction, across the filling station 22, the pre-forming station 24, the pre-heating station 26, and the top end sealing station 28. A second wall 36 is arranged in parallel with the first wall 32. The second wall 36 extends on the opposite side of the transport path 50 from the outfeed end of the disinfection station 16, in a machine direction, across the filling station 22, the pre-forming station 24, the pre-heating station 26, and the top end sealing station 28.

A third wall 34 is arranged in a direction perpendicular to the direction of the first and second walls 32, 36, at the downstream end of the inner hygienic zone 30. Hence, the third wall 34 connects the first and second walls 32, 36 and forms an exit wall for the packages 4 leaving the inner hygienic zone 30. From this, it should be evident that the third wall 34 is provided with some kind of opening for allowing packages to exit the inner hygienic zone 30.

The walls 32, 34, 36, which can be of a total number greater than three, thereby delimits a U-shaped space protecting the disinfected packages from the outside environment, as will be further explained below. More specifically, the walls 32, 34, 36 of the inner hygienic zone 30 forms a barrier when the filling machine 10 is accessed for service and maintenance.

The filling machine 10 has a housing 60, which forms an outer shell of the filling machine. One or more doors 62, 64 are provided at the housing 60 in order to allow staff to enter the filling machine interior in order to investigate equipment and perform various tasks to the filling machine 10. Typically, doors 62, 64 may be arranged at the infeed station 12 as well as at the top end sealing station 28. Especially at the top end sealing station 28, which is arranged inside the hygienic chamber 20, it is desired to maintain as hygienic conditions as possible. Due to the provision of the inner hygienic zone 20, which is delimited from the rest of the hygienic chamber 20, staff can enter the hygienic chamber 20 via the door 64 without exposing the packages 4 present in the inner hygienic zone 30 to an increased risk of re-contamination.

Preferably, as much mechanical parts as possible are arranged outside the inner hygienic zone 30 in order to allow service and maintenance without the need for entering the inner hygienic zone 30.

The walls 32, 34, 36 of the inner hygienic zone 30 are preferably moveable in relation to the filling machine housing 60, such that the size of the inner hygienic zone 30 can be adjusted. The first and second walls 32, 36 may for this purpose be moveable in the direction transverse to the machine direction, while the third wall 34 may be extendable/retractable in order to be able to form a closure between the first and second walls 32, 36.

Also, at least one of the walls 32, 34, 36 of the inner hygienic zone 30 is preferably openable, e.g. by a sliding door mechanism, such that also the inner hygienic zone 30 can be accessed for service and maintenance. Such opening may preferably be provided with a sensor, providing a signal when the inner hygienic chamber has been opened. Hence, it is possible to monitor if and when the inner hygienic zone 30 has been accessed.

As can be seen in FIG. 2 the inner hygienic zone 30 may be provided with a partition wall 38; the partition wall 38 is arranged between the filling station 22 and the pre-heating station 24. The purpose of the partition wall 38 is to provide a thermal barrier for the filling station 22, in order to prevent excessive heat from the pre-heating station 24 to heat up the filling station 22. The partition wall 38 (which is provided with some kind of opening in order to let packages to pass through), is advantageous in particular when a chilled product is to be filled.

Figure 3:
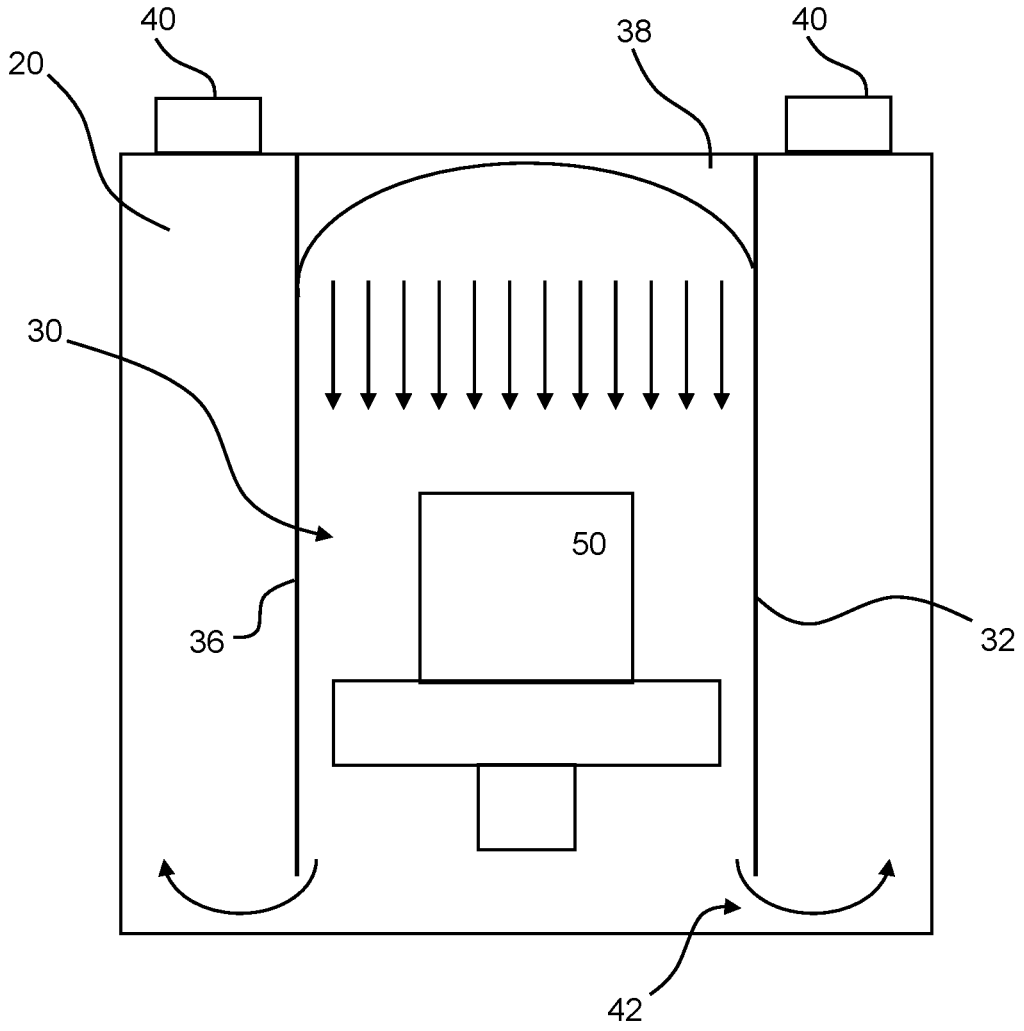
FIG. 3 is a cross-sectional view of a filling machine according to an embodiment.

Now turning to FIG. 3 a schematic representation of the hygienic chamber 20 is shown in cross-section. The inner hygienic zone 30 extends laterally between the two walls 32, 36. Inside the inner hygienic zone 30 the transport path 50 is arranged, here only schematically represented by simple geometries. The separation walls 32, 36 extends from the ceiling and downwards, leaving a slit 42 between their bottom end and the floor. This slit 42 is provided in order to ensure a positive air flow from the inner hygienic zone 30 to the outside hygienic chamber 20.

The ceiling of the inner hygienic zone 30 is provided with air filter units 38, preferably in the form of HEPA filters. The HEPA filters 38 will ensure a positive flow of clean and filtered air downwards. The air flow will be directed towards the floor, as indicated by the arrows, and forced out from the inner hygienic zone 30 through the slits 42. The air will eventually be evacuated by means of air evacuation units 40 arranged at the ceiling of the hygienic chamber 20, but outside the inner hygienic zone 30.

Figure 4:
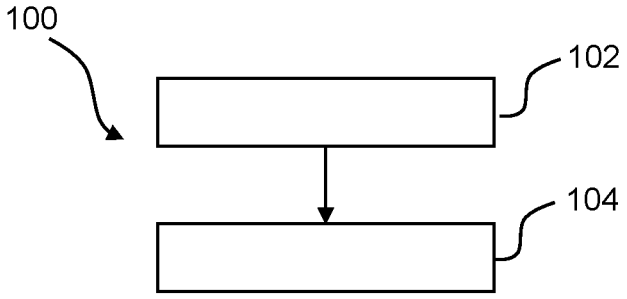
FIG. 4 is a schematic view of a method according to an embodiment.

Now turning to FIG. 4, a method 100 for a filling machine 10 is schematically illustrated. As explained earlier, the filling machine 10 is configured to form, fill, and seal individual packages 4, whereby the filling machine comprises a disinfection station 16 and a hygienic chamber 20 downstream the disinfection station 16, which hygienic chamber 20 is configured to reduce the risk for re-contamination of the packages after passing the disinfection station 16. The method 100 comprises a first step 102 of providing an inner hygienic zone 30 inside the hygienic chamber 20, and a second step 104 of establishing a positive air flow from the inner hygienic zone 30 to the hygienic chamber 20 outside the inner hygienic zone 30.

Figure 5A:
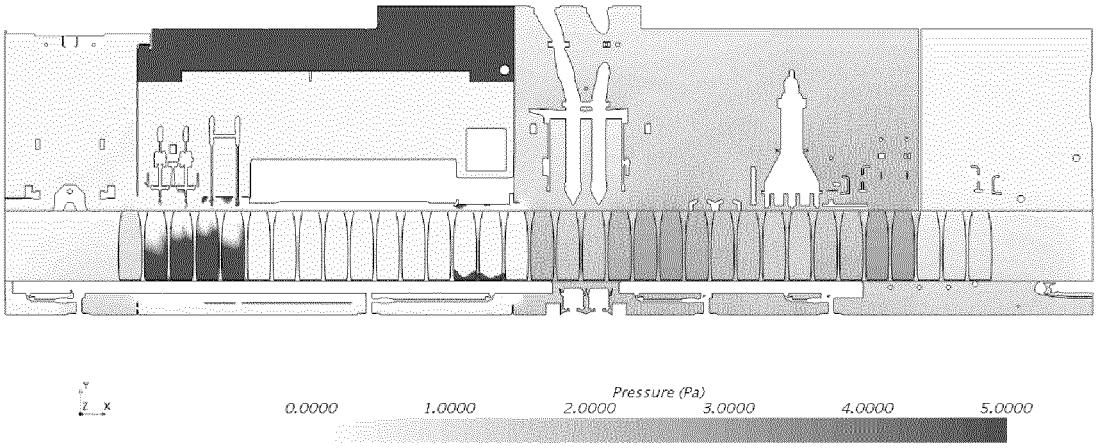
FIGS. 5*a-c* are simulation graphs of a filling machine according to an embodiment being subject to contamination during operation.
Figure 5B:
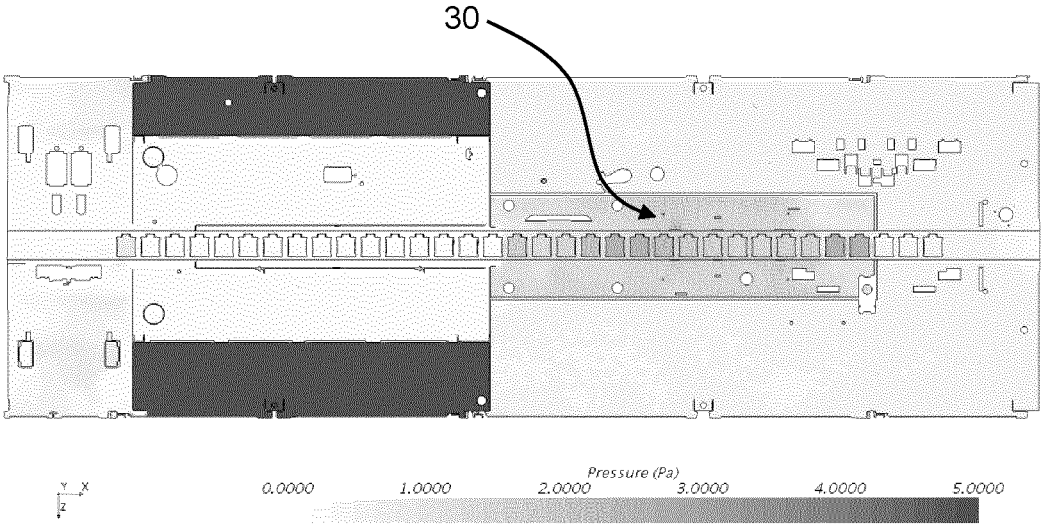
Figure 5C:
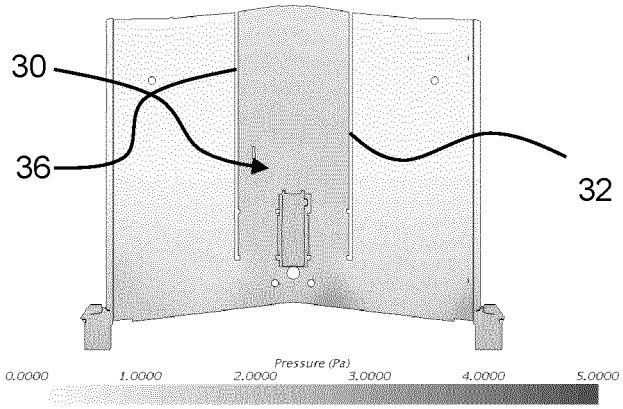

Now turning to FIGS. 5*a-c* the filling machine 10 is illustrated during a simulation in which a gas, representing a potential contamination, is released from the entire bottom surface of the disinfection station 16 and of the hygienic chamber 20. As can be seen in FIG. 5*a*, which is a cross-sectional side view of the filling machine 10, the concentration of the contamination gas is substantially less at the inner hygienic zone 30; this is even more clear from FIG. 5*b*, which is a cross-sectional top view of the filling machine 10. From the cross-sectional view of FIG. 5*c* (the same view as of FIG. 3), it can be seen that the inner hygienic zone 30 is substantially free from any contamination gas.

Figure 6A:
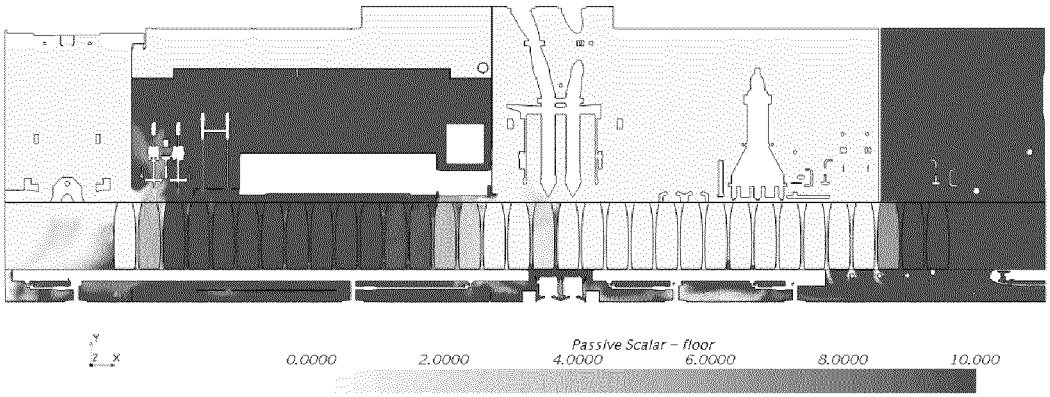
FIGS. 6*a-c* are simulation graphs of the pressure of a filling machine according to an embodiment during operation.
Figure 6B:
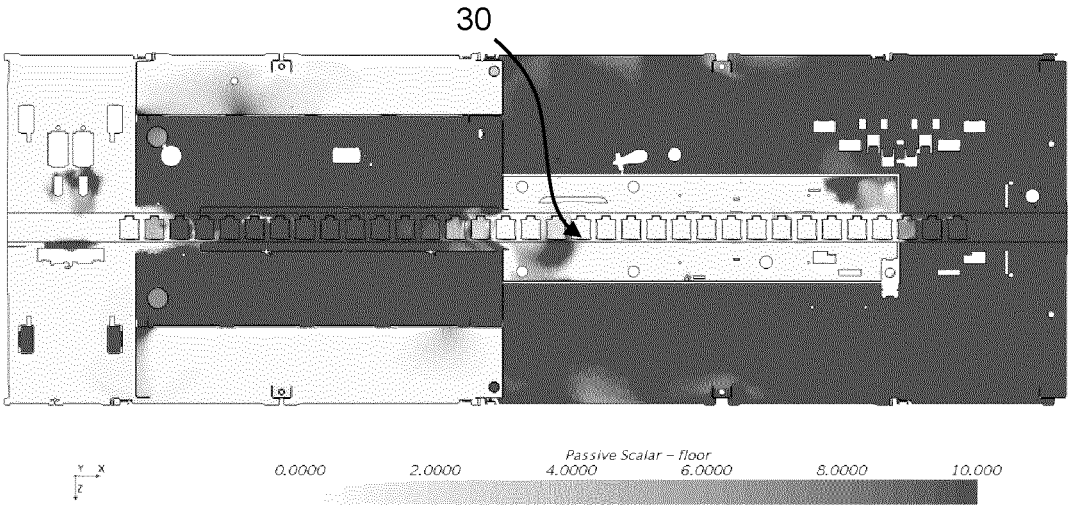
Figure 6C:
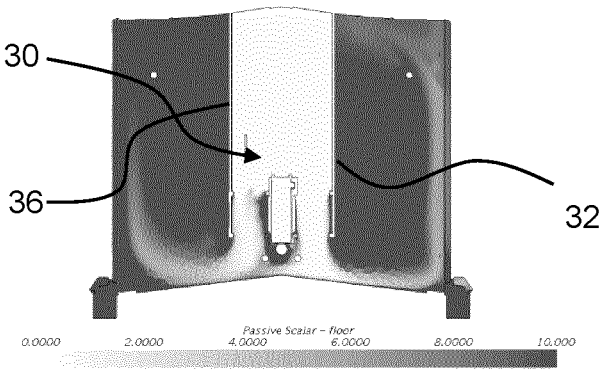

In FIGS. 6*a-c* the pressure distribution is shown during operation of the filling machine 10. These views, being the same cross-sections as for FIGS. 5*a-c*, show that there is a small, but well defined, pressure gradient created at the areas where the inner hygienic zone 30 opens to the outside hygienic chamber 20.

Figure 7:
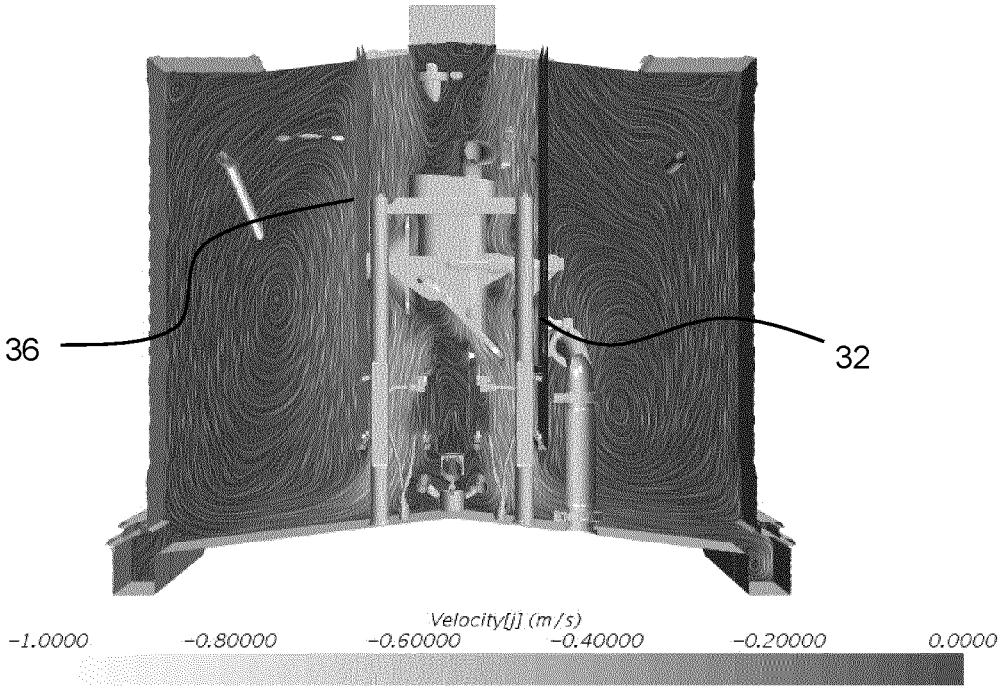
FIG. 7 is a simulation graph of the air flow of a filling machine according to an embodiment during operation.

FIG. 7 is another cross-sectional view of the filling station 22, illustrating the air flow through the inner hygienic zone 30. The HEPA filters 38 provide for a downward uniform clean air flow.

A cold environment is established inside the hygienic zone 30 at the filling area, thereby minimizing microbiological growth inside the filling station 22. This cold environment is ensured due to the partition wall 38 shown in FIG. 2.

As described above, the presented solution assists in preventing recontamination of the hygienic chamber 20 both during production mode and during stops in production.

A robust protection of the critical inner hygienic zone 30 is obtained as a small but defined pressure gradient is established between the inner hygienic zone 30 and the outer hygienic chamber 20. Furthermore it prevents contamination from the cassette/conveyor/transport path 50 of the critical areas.

During stops in production when the hygienic chamber 20 needs to be accessed, the risk of causing contamination when opening of the large doors 62, 64 to the hygienic chamber 20 is reduced as the small divider walls 32, 34, 36 only open the relatively small area when access is required. Additional benefits with the proposed concept also include a simplified supply system design as also the evacuation system can be placed above the hygienic chamber ceiling and as the divider walls 32, 34, 36 prevent splashing of the evacuation system design. Even further, a more efficient utilization of the HEPA filter is accomplished, thereby reducing the demands in terms of flow capacity.

From the description above follows that, although various embodiments of the invention have been described and shown, the invention is not restricted thereto, but may also be embodied in other ways within the scope of the subject-matter defined in the following claims.

The invention claimed is:

1. A filling machine configured to form, fill, and seal individual packages, comprising a disinfection station and a hygienic chamber, which hygienic chamber is configured to reduce the risk for re-contamination of the packages after passing the disinfection station, an inner hygienic zone formed by a plurality of separation plates inside said hygienic chamber, whereby a positive air flow is established from the inner hygienic zone to the hygienic chamber outside the inner hygienic zone, the separation plates being distributed in an U-shape, such that at least two longitudinal separation plates extend in a machine direction, and at least one transversal separation plate extends perpendicular to the machine direction, connecting the at least two longitudinal separation plates.

2. The filling machine according to claim 1, wherein at least one of the separation plates is moveable such that the inner hygienic zone can be opened and accessed.

3. The filling machine according to claim 2, wherein the separation plates extend from a ceiling towards a floor, leaving a slit between a bottom end of the respective separation plates and the floor.

4. The filling machine according to claim 1, wherein at least one of the separation plates is moveable in order to increase or reduce a size of the inner hygienic zone.

5. The filling machine according to claim 4, wherein the filtered air unit is a HEPA filter unit.

6. The filling machine according to claim 1, wherein the inner hygienic zone is open towards the upstream disinfection station.

7. The filling machine according to claim 1, wherein the inner hygienic zone is provided with a filtered air unit.

8. The filling machine according to claim 7, wherein the filtered air unit is arranged at a ceiling of the inner hygienic zone.

9. The filling machine according to claim 7, wherein the positive air flow from the inner hygienic zone is controlled by controlling the air flow of the filtered air unit.

10. The filling machine according to claim 1, wherein the hygienic chamber comprises an air evacuation unit arranged outside the inner hygienic zone.

11. The filling machine according to claim 10, wherein the air evacuation unit is arranged at a ceiling of the hygienic chamber.

12. A method for a filling machine configured to form, fill, and seal individual packages, whereby the filling machine comprises a disinfection station and a hygienic chamber, which hygienic chamber is configured to reduce the risk for re-contamination of the packages after passing the disinfection station, the method comprising:

providing an inner hygienic zone inside said hygienic chamber, and establishing a positive air flow from the inner hygienic zone to the hygienic chamber outside the inner hygienic zone, wherein the inner hygienic zone is formed by a plurality of separation plates inside said hygienic chamber, the separation plates being distributed in an U-shape, such that at least two longitudinal separation plates extend in a machine direction, and at least one transversal separation plate extends perpendicular to the machine direction, connecting the at least two longitudinal separation plates.

* * * * *